US006200457B1

(12) United States Patent
Durand et al.

(10) Patent No.: US 6,200,457 B1
(45) **Date of Patent: *Mar. 13, 2001**

(54) ELECTROACTIVATED MATERIAL, ITS PREPARATION AND ITS USE IN PRODUCING CATHODE COMPONENTS

(75) Inventors: Robert Durand, Saint-Martin d'Heres; Jean-Guy Le Helloco, Le Pre-Saint Gervais, both of (FR)

(73) Assignee: Rhone-Poulenc Chimie, Courbevoie Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/464,576

(22) Filed: Dec. 16, 1999

Related U.S. Application Data

(63) Continuation of application No. 08/669,573, filed as application No. PCT/FR95/00167 on Feb. 13, 1995, now abandoned.

(30) Foreign Application Priority Data

Feb. 15, 1994 (FR) ..... 94 01702

(51) Int. Cl.[7] ..... C25C 1/02; H01B 1/00

(52) U.S. Cl. ..... 205/771; 205/687; 204/280; 204/282; 204/291; 252/506; 252/518.1; 252/520.3; 427/126.5; 427/243; 428/367; 428/379; 428/403; 428/469; 502/101; 502/326

(58) Field of Search ..... 502/101, 326; 252/514, 506, 520.3, 518.1; 204/280, 282, 283, 291, 292, 294; 427/126.5, 243; 428/368, 373, 367, 379, 469, 403; 205/687, 771

(56) References Cited

U.S. PATENT DOCUMENTS 4,236,993 * 12/1980 Muller et al. ..... 204/294
4,940,524 * 7/1990 Perineau et al. ..... 204/292 X
5,679,225 * 10/1997 Pastacaldi et al. ..... 204/292 X

FOREIGN PATENT DOCUMENTS 0 319 517 * 6/1989 (EP) .

* cited by examiner

*Primary Examiner*—Fred Teskin
(74) *Attorney, Agent, or Firm*—Burns, Doane, Swecker & Mathis, L.L.P.

(57) ABSTRACT

The present invention relates to an electroactivated material comprising fibers and a binder and additionally having an electrocatalytic agent in the form of particles comprising a precious metal oxide or in the form of particles comprising a support and a coating based on such an oxide. The electroactivated material can be used especially as cathode component of an electrolysis cell and in particular of a cell for the electrolysis of aqueous sodium chloride solutions. The present invention also relates to a composite material comprising the said material and to processes for the preparation of each of the two materials.

18 Claims, No Drawings

ELECTROACTIVATED MATERIAL, ITS PREPARATION AND ITS USE IN PRODUCING CATHODE COMPONENTS

This application is a Continuation Application of application Ser. No. 08/669,573 filed on Apr. 5, 1999, now abandoned, which is an Application under 35 U.S.C. Section 371 of International Application number PCT/FR95/00167, filed on Feb. 13, 1995.

The present invention relates to an electroactivated material comprising fibres and a binder and additionally having an electrocatalytic agent in the form of particles comprising a precious metal oxide or in the form of particles comprising a support and a coating based on such an oxide.

The electroactivated material can be used especially as cathode component of an electrolysis cell and in particular of a call for the electrolysis of aqueous sodium chloride solutions.

Moreover, it relates to a composite material comprising the said material and to processes for the preparation of each of the two materials.

In recent years, the use of cathodes consisting of a metal surface on which is deposited a fibrous shoot and then optionally a diaphragm has spread in the field of the electrolysis of aqueous sodium chloride solutions. Such cathodes have a low overpotential with respect to the reaction for the production of hydrogen at the cathode and for this reason have made it possible to reduce energy consumption.

Moreover, it is-known to add electrocatalytic agents, such as nickel, for example, to the abovementioned sheet in order to increase further the behaviour thereof. These agents can be used in the form of a powder dispersed in the abovementioned fibrous sheet or alternatively in a for of a deposit on the said sheet, obtained, for example, by an electrochemical route However, cathodes of this type do not have a very high resistance to poisoning, due to the nature of the electrocatalytic agents, and are therefore relatively rapidly deactivated.

The aim of the present invention is to propose an electroactivated material and a composite material comprising the latter, which can be used as cathode in a cell for the electrolysis of aqueous sodium chloride solutions, in which the resistance to poisoning and, consequently, the lifetime are increased.

The first subject of the present invention is therefore an electroactivated material comprising fibres, of which at least a part is electrically conducting, and a binder and additionally comprising an electrocatalytic agent consisting of particles formed of ruthenium, platinum, palladium or iridium oxide, or their mixture, or of one or several of the said oxides distributed at least partly over an electrically-conducting support.

A second subject of the invention consists of a composite material comprising (a) a material of high porosity and (b) the abovementioned electroactivated material.

A third subject of the invention consists of a composite material comprising, from one face towards the other: (a) a metal surface of high porosity, (b) the abovementioned electroactivated material and (c) a separator.

The invention also relates to a method for the preparation of an electroactivated material which consists in carrying out the following stages:

(a) an aqueous suspension comprising the fibres, the binder, the electrocatalytic agent and optionally adjuvants is prepared, (b) a shoot in deposited by filtering the said suspension, under programmed vacuum, through a material of high porosity, (c) the liquid in removed and the sheet thus formed is optionally dried, (d) the shoot thus obtained is optionally sintered.

The final subject of the present invention in a method for the preparation of a composite material. This consists in carrying out the following stages:

(a) an aqueous suspension comprising the fibres, the binder, the electrocatalytic agent and optionally adjuvants is prepared, (b) a shoot is deposited by filtering the said suspension, under programmed vacuum, through a material of high porosity, (c) the liquid is removed and the shoot thus formed is optionally dried, (d) the sheet thus obtained is optionally sintered, (e) a dispersion, in water or in an aqueous sodium hydroxide solution, comprising fibres, a binder and optionally adjuvants is deposited on the said sheet by filtering under programmed vacuum, (f) the liquid is removed and the diaphragm thus formed is optionally dried, (g) the whole unit is sintered.

However, other advantages and characteristics of the invention will become more clearly apparent on reading the description and examples which will follow.

As was indicated above, the electrocatalytic agent which forms part of the composition of the electroactivated material according to the invention can be provided in the form of particles based on ruthenium, platinum, iridium or palladium oxide, these oxides being alone or as a mixture. The said agent can additionally be provided in the form of particles consisting of an electrically-conducting support comprising, for at least part of the said particles, a coating in the form of ruthenium, platinum, iridium or palladium oxide, these oxides being alone or as a mixture.

In the following, the abovementioned list will be denoted by the term precious metal(s). It is understood that the term precious metal will subsequently represent, without distinction, one or several of the abovementioned metals.

The combination of these two variants can, of course, be envisaged.

Mixture is understood to mean, first of all, particles comprising several oxides or alternatively particles, containing at least one oxide, mixed with other particles comprising at least one different oxide, or finally these two possibilities simultaneously. Such a definition is valid whether the oxides are found throughout the thickness of the particle or simply in the form of a coating.

The electrocatalytic agent according to the invention is preferably provided in the form of a coating on a support.

The support consists of a material which is electrically conducting and stable under the conditions of a subsequent application of the material (pH and temperature, especially).

More particularly, the latter is chosen from iron, cobalt, nickel, Raney iron, Raney cobalt, Raney nickel, the elements of columns IVA and VA of the periodic classification, carbon or graphite. Here and throughout the description, the comments relating to the table of the periodic-classification of the elements refer to that which appeared in the supplement to the Bulletin de la Société Chimique de Prance (No. 1, January 1966).

The support is preferably provided in the form of a powder.

More particularly, the particle size of the support is between 1 and 100 $\mu$m.

The specific surface of the said support is not greater than 1000 $m^2/g$. More particularly, the specific surface varies between 5 and 500 $m^2/g$.

The proportion by weight, between the coating and the support, varies between 0.5 and 50. It should be noted that proportions outside, and more particularly higher than, those indicated above can be envisaged. However, this does not introduce specific advantages for the behaviour of the electroactivated material, while needlessly increasing its cost.

The electrocatalytic agent according to the invention can additionally comprise additives chosen from iron, cobalt, nickel and/or their oxides.

The proportion of the said additives, with respect to the precious metal oxide (by weight), varies from 0 to 50%.

The electrocatalytic agent which forms part of the composition of the electroactivated material according to the invention can be distributed either uniformly within the said material or else be gathered together in a specific region of the latter, for example at the periphery.

However, according to a preferred implementational variant of the invention, the electrocatalytic agent is uniformly distributed throughout the body of the electroactivated material.

The amount of electrocatalytic agent in the material according to the invention represents 10 to 70% by weight, with respect to the combined fibres, binder and electrocatalytic agent.

In addition to this electrocatalytic agent, the material according to the invention comprises fibres, of which at least a part is electrically conducting.

These fibres are provided in the form of filaments, the diameter of which is generally less than 1 mm and preferably between $10^{-5}$ and 0. 1 mm, and the length of which is greater than 0. 5 mm and preferably between 1 and 20 mm, the said material having a resistivity equal to or less than 0.4 ohm·cm.

The said fibres can consist entirely of an intrinsically electrically-conducting material. Mention may be made, as examples of such materials of metal fibres, and in particular iron fibres, ferrous alloy fibres or nickel fibres, or carbon or graphite fibres.

It is also possible to use fibres resulting from material which in not electrically conducting but which are made conducting by a treatment: mention may be made, as examples, of asbestos fibres or zirconia fibres made conducting by chemical or electrochemical deposition of a metal such as nickel. In the case of fibres made conducting by treatment, the latter will be carried out under conditions such that the resulting fibre has the resistivity mentioned above.

According to a preferred embodiment of the invention, the electroactivated material comprises intrinsically conducting fibres and more particularly carbon or graphite fibres.

Moreover, use is made of fibres having a monodispersed length, that is to say that the length of at least 80% and more particularly 90% of the fibres corresponds to the mean length of the fibres to ±20% and advantageously to about ±10%.

The conducting fibres can additionally be combined with non-electrically-conducting fibres insofar as the resistivity of the material is not greater than 0.4 ohm·cm. These fibres are generally provided in the form of filaments, the geometric characteristics of which are analogous to those given for the conducting fibres but the resistivity of which will be, by convention, greater than 0.4 ohm·cm.

Mention may especially be made, as illustration of non-conducting fibres, of inorganic fibres, such as asbestos fibres, glass fibres, quartz fibres, zirconia fibres or titanate fibres, or organic fibres, such as polypropylene or polyethylene fibres, the polypropylene or polyethylene optionally being halogenated and especially fluorinated, polyhalovinylidene fibres and especially poly(vinylidene fluoride) fibres, or alternatively fluorinated polymer fibres, which will arise later with respect to the binder of the sheets in accordance with the invention.

According to a first variant, use is made of asbestos fibres in particular in combination with carbon or graphite fibres.

According to a second variant, polytetrafluoroethylene fibres, hereinafter known as PTFE fibres, art taken, in particular in combination with inorganic fibres mentioned previously.

Preferably, the PTFE fibres have a diameter (D) generally between 10 and 500 $\mu$m and their length (L) is such that the ratio L/D is between 5 and 500. Recourse is preferably had to PTFE fibres in which the mean dimensions are between 1 and 10 mm, for the length, and between 50 and 200 $\mu$m, for the diameter. Their preparation is described in U.S. Pat. No. 4,444,640 and this type of PTFE fibres is known to those skilled in the art.

In a combination of conducting and non-conducting fibres, the proportion of non-conducting fibres can represent up to 90% by weight and preferably be between 20 and 70%.

The electroactivated material according to the invention moreover comprises a binder chosen from fluorinated polymers. Fluorinated polymer is understood to moan a homopolymer or a copolymer derived, at least in part, from olefinic monomers which are entirely substituted with fluorine atoms or entirely substituted with a combination of fluorine atoms and of at least one of the chlorine, bromine or iodine atoms per monomer.

Examples of fluorinated homo- or copolymers can consist of polymers and copolymers derived from tetrafluoroethylene, hexafluoropropylene, chlorotrifluoroethylene or bromotrifluoroethylene.

Such fluorinated polymers can also contain up to 75 mol per cent of units derived from other ethylenically unsaturated monomers containing at least as many fluorine atoms as carbon atoms, such as, for example, vinylidene (di)fluoride or ethers of vinyl and of perfluoroalkyl, such as perfluoroalkoxyethylene.

It is naturally possible to use in the invention several fluorinated homo- or copolymers as defined above. It goes without saying that it would not be departing from the scope of the invention to combine with these fluorinated polymers a small amount, for example up to 10 or 15% by weight, of polymers in which the molecule does not contain fluorine atoms, such as, for example, polypropylene.

The binder can be provided either in the form of a dry powder or of a latex, that is to say of an aqueous suspension in which the solids content is between 30 and 70%.

The amount of fibres in the electroactivated material of the present invention represents 10 to 65% by weight, with respect to the combined fibres, binder and electrocatalytic agent.

The amount of binder is between 5 and 20% by weight, with respect to the combined fibres, binder and electrocatalytic agent. However, in order to ensure good consolidation in the electroactivated material, the binder preferably represents 20 to 50% by weight with respect to the fibres and binder subsystem.

The materials according to the present invention can also contain adjuvants such as, in particular, surface-active agents.

Use may in particular be made, as non-ionic surface-active agent, of ethoxylated alcohols or fluorocarbon compounds containing functionalized groups, alone or as a mixtures those alcohols or these fluorocarbon compounds generally have $C_6$ to $C_{20}$ carbon chains. Use is preferably made of ethoxylated alcohols which are ethoxylated alkylphenols, such as, in particular, octoxynols.

The amount of surface-active agent which can be present in the sheets according to the invention can reach 10% by weight, with respect to the combined fibres, binder and electrocatalytic agent, and more specifically from 0.1 to 5% by weight, with respect to the combined fibres, binder and electrocatalytic agent.

It is likewise possible to use a thickener. "Thickener" is understood to mean, according to the present invention, a compound which increases the viscosity of the solution and which has water-retaining properties. Natural or synthetic polysaccharides are generally used. Mention may in particular be made of biopolymers obtained by fermentation of a carbohydrate under the effect of microorganisms. Xanthan gum is advantageously used. Xanthan gum is synthesized using bacteria belonging to the genus Xanthomonas and more particularly to the species described in Bergey's Manual of Determination Bacteriology (8th edition—1974—Williams N. Wilkins Co., Baltimore), such an *Xanthomonas begonias, Xanthomonas campostris, Xanthomonas carotao, Xanthomonas hoderac, Xanthomonas incanae, Xanthomonas malvacearum, Xanthomonas papavericola, Xanthomonas phaseoli, Xanthomonas pisi, Xanthomonas vasculorum, Xanthomonas vesicatoria, Xanthomonas vitians* or *Xanthomonas pelargonil.* The species *Xanthomonas campestris* is very particularly highly suited for the synthesis of xanthan gum.

Mention may be made, among other microorganisms capable of producing polysaccharides of similar properties, of bacteria belonging to the genus Arthrobacter, to the genus Erwinia, to the genus Azobacter or to the genus Agrobacter or fungi belonging to the genus Sclerotium.

Xanthan gum can be obtained by any means known per se. The polysaccharide is conventionally isolated from the fermentation broth by evaporation, drying and milling or by precipitation by means of a lower alcohol, separation from the liquid, drying and milling so as to obtain a powder. Commercially available powders have a particle size generally between 50 and 250 $\mu$m and an apparent density greater than approximately 0.7.

The amount of thickener generally varies between 0.1 and 5% by weight, with respect to the combined fibres, binder and electrocatalytic agent.

The materials can also contain porogenic agents.

It is understood that when porogenic agents are resorted to, the final material, the porosity of which in adjusted or modified under the effect of decomposition or removal of these agents, in principle no longer contains such agents. Mention may be made, as illustration of porogenic agents, of inorganic salts, which can then be removed by leaching, as well as salts which can be removed by chemical or thermal decomposition.

These various products can in particular be chosen from alkali metal or alkaline-earth metal salts, such as halides, sulphates, sulphonates, bisulphites, phosphates, carbonates or bicarbonates. Amphoteric alumina may also be mentioned.

According to a specific embodiment of the invention, use is made of silica or derivatives, as porogenic agent, which can be removed subsequently with an alkaline treatment.

All types of silica are suitable for this use and more particularly precipitated silicas or pyrogenic silicas.

The specific surface of the said silica is more particularly between 100 and 300 $m^2/g$.

The amount and the particle size of the porogenic agents are closely linked to the application for which the materials are intended. Simply by way of order of size, the particle size of the porogenic agents most often varies between 1 and 50 $\mu$m and preferably between 1 and 15 $\mu$m. The amount is chosen according to the desired porosity, it being possible for the latter to reach 90% or indeed more (according to ASTN Standard D 276-72).

A second subject of the present invention consists of a composite material comprising a compound of high porosity and the electroactivated material described above.

The compound of high porosity is generally chosen from metal surfaces or else alternatively from cloths, such as asbestos cloths, in which the mesh opening can be between 20 $\mu$m and 5 mm.

According to a preferred embodiment, the compound of high porosity is a metal surface, known as elementary cathode, which is more particularly made of iron, nickel or alternatively stainless steel.

It is generally found in the form of a mesh or of a perforated metal component which more particularly acts as a cathode in an electrolysis cell. The said cathode can consist of a flat surface or of an assembly of flat surfaces or, in the case of electrolysis cells of the "glove finger" type, be provided in the form of cylinders, the directrix of which in a more or less complex surface, generally substantially rectangular with rounded corners.

The composite material can additionally be combined with a separator which can be a diaphragm or a membrane.

Generally, diaphragms comprise fibres and a binder chosen from fluorinated polymers, as well as conventional adjuvants.

Everything which has been said previously concerning fibres, binder and adjuvants which can be used remains valid and will consequently not be taken up again in this part.

In order not to go into excessively lengthy details, it is specified that the techniques for the manufacture of membranes and porous and microporous diaphragms are described in the following French Patents: FR 2,229,739, FR 2,280,435 and FR 2,280,609 and French Patent Applications FR 81 9688 and 85 4327, FR 89 10938 and FR 89 10937, the contents of which are incorporated here.

Before describing a method for the preparation of the activated material and of the composite material according to the invention, a process for the preparation of the electrocatalytic agent will be presented.

The electrocatalytic agent used in the present invention can be obtained by any means known to those skilled in the art which makes it possible in particular, in the case of supported particles, to gain access to a structure of particles comprising a support having a coating.

One of the suitable methods consists in preparing a suspension or a solution of a ruthenium, platinum, palladium or iridium compound, or of their mixture, optionally in the presence of the abovementioned additives and/or support.

The compounds of the said precious metals used for the preparation of the electrocatalytic agents according to the invention are chosen from oxides or compounds capable of being converted to oxide by an appropriate heat treatment (precursor).

Mention may be made, as precursors, without intending to be limiting, of salts of organic or inorganic acids such an, for example, nitrates, halides, carbonates, sulphates, acetates, acetylacetonates, oxalates, tartrates, malonates or succinates.

Thus, ruthenium chloride, hexachloroplatinic acid, hexachloroiridic acid, palladium nitrate, palladium chloride, iridium chloride or ruthenium nitrosotrinitrat.

Theme salts are therefore suspended or dissolved in a solvent. The solvent is generally chosen from water or $C_1$–$C_6$ alcohols, such as methanol, ethanol or isopropanol.

The content of precious metal salt of the solution or suspension is generally between 0.1 and 5 M.

In the case where additives form part of the composition of the electrocatalytic agents, these can be provided in an oxide form or in the form of oxide precursors or alternatively in a metal form. If precursors are employed, that which has been said above with respect to precious metal precursors remains valid.

If a support is used and according to its nature, it may be preferable to employ it after having undergone a specific surface treatment.

Thus, in the case where carbon is used as support, an oxidation is first of all carried out in order to increase the concentration of oxygen-containing groups at the surface. The treatment can be carried out in the presence of inorganic acids, such as nitric acid or sulphuric acid in particular, or by heat treatment under an oxidizing atmosphere.

The oxidation is preferably carried out in the liquid phase by imersing the carbon in a nitric acid solution at boiling point for approximately one hour. On conclusion of this treatment, the product obtained in filtered and then rinsed with water.

If the support used is pyrophoric, as is in particular the case for Raney nickel, a controlled oxidation is carried out, in the presence of hydrogen hydroperoxide, for example.

According to a first variant of the preparation of an electrocatalytic agent according to the invention, all the constituent components of the said agent are mixed in the form of a solution or suspension.

This variant is particularly appropriate in the came where the agent comprises a support and in the case where use in made of a precursor malt of the precious metal oxides, if appropriate comprising additives.

Mixing is generally carried out with stirring at a temperature in the region of room temperature.

The components are brought into contact for a period of time from a few minutes to 24 hours.

According to a second variant, a solution or a suspension of the constituent components of the electrocatalytic agent is prepared and a precipitation stage in carried out. In such a came, the precious metal is used in the form of a solution of precursors.

An agent which precipitates at least the said metal is added to the solution or suspension. It should be noted that precipitation of the additives, if they are present, is also possible.

All compounds are capable of being used insofar an they combine at least with the precious metal in the form of an insoluble compound. Mention may be made, by way of example, of the hydroxide, the carbonate or the bicarbonate of an alkali metal or alkaline-earth metal, such as sodium, calcium or potassium. Mention may likewise be made of aqueous ammonia.

The precipitating agent is conventionally introduced into the support/precious metal mixture but simultaneous introduction can be carried out.

This operation takes place with stirring and at a temperature in the region of room temperature.

In such a case, it is possible to allow, after introduction of the precipitating agent, a period of maturing, optionally with stirring, for 1 to 10 hours.

Following the filtration, the resulting solid is generally rinsed with a solvent which can be identical to or different from that used for the operation of bringing the components into contact.

Whatever the variant used, the following stage is a drying stage.

According to a first embodiment, this operation can take place under vacuum or under air at a temperature between room temperature and the temperature at which the solvent is removed.

The duration of this operation is from approximately a few minutes to 12 hours.

A second embodiment consists in drying the solution by atomization.

The latter can be carried out by means of any sprayer known per se, especially of Büchi type.

However, according to a specific embodiment, equipment is used as described in French Patent Applications FR 2,257,326, FR 2,419,754 and FR 2,431,321. In this case, the treating gases are driven with a helical movement and flow in a vortex sink. The solution or suspension to be dried is injected along a trajectory which joins with the axis of symmetry of the helical trajectories of the gases, which makes it possible to completely transfer the amount of movement of the gases to the said solution or suspension. The gases thus provide a double function, spraying of the solution or suspension (conversion into fine droplets) and drying of the said droplets. Moreover, the residence time is less than 0.1 second, which does away with any risk of overheating as a result of an excessively long contact with the games.

The treatment temperature is such that it makes it possible to evaporate the solvent and indeed, in the case where a precious metal salt has been used, to begin conversion of the said salt to the oxide.

Generally, and depending on the respective flow rates of the gases and of the solution or suspension to be dried, the inlet temperature of the gases is between 600 and 900° C., preferably between 700 and 900° C., and the outlet temperature of the gases between 100° C. and 300° C., preferably between 150° C. and 250° C.

Prior to the drying, a stage of separation of the solid can be carried out if the variant used comprises passing through a suspension.

The separation is generally carried out by filtration or centrifugation.

Filtration is carried out by any means known to those skilled in the art, at atmospheric pressure or under vacuum.

The dried product obtained in then subjected to a heat treatment for the purpose of converting the precious metal salt to the oxide.

This operation is carried out under a stream of air or oxygen at a temperature between 200 and 800° C., depending on the nature of the precursor.

The duration depends on the nature of the support, if it in present. Thus, the duration of the heat treatment can be longer if the support withstands high temperatures without deteriorating or being converted to a compound which is not electrically conducting.

By way of indication, the duration varies from a few seconds to 1 hour.

On conclusion of the heat treatment, the particles can be deagglomerated by any means known to those skilled in the art, such as milling.

Finally, additional stages of rinsing followed by filtration or centrifugation and by drying can be carried out.

Everything which has been described above regarding theme stages remains valid and will not be taken up again here.

The mechanical synthesis represents another method which is suitable for the preparation of the electrocatalytic agent.

This method is particularly appropriate when a support, a precious metal compound and optionally additives are used in the solid form. In this came, a support in used which has a greater hardness than that of the two abovementioned compounds.

In this way, after milling the combined compounds, particles are obtained formed from the support, the periphery of which is enriched in precious metal compound and optionally additives.

On conclusion of the milling a heat treatment may be necessary to convert the precious metal compound into the corresponding oxide.

This operation is then carried out under an oxidizing atmosphere at temperatures varying, depending on the nature of the compound to be converted, between 200 and 800° C.

If the compound is used in the oxide form, the heat treatment is not necessary.

A method for the preparation of the electroactivated material will now be described.

Thus, the material according to the invention is capable of being obtained by implementing the following stages:

(a) an aqueous suspension comprising fibres, binder, electrocatalytic agent and optionally adjuvants is prepared, (b) a sheet is deposited by filtering the said suspension, under programmed vacuum, through a material of high porosity, (c) the liquid is removed and the sheet thus formed is optionally dried, (d) the sheet thus obtained is optionally sintered.

The amount of each of the various constituents of the aqueous suspension prepared in Stage (a) is such that it makes it possible to obtain a material having the composition characteristics in particular stated previously.

In a known way, and mainly for reasons of ease of handling on an industrial scale, the solids content (that is to say fibres, binder, electrocatalytic agent and adjuvants) of the abovementioned dispersion is low. It is generally of the order of 1 to 5% by weight of the whole mixture.

Moreover, it can be advantageous to incorporate, in the said suspension, a thickening agent such an, for example, natural or synthetic polysaccharides.

The dispersion can be obtained by mixing each of the constituents in the required proportions with water, optionally with adjuvants of the surface-active agent or thickener type added.

A sheet in then formed from the resulting dispersion by filtering, under programmed vacuum, through a material of high porosity. The vacuum programme consists in moving from atmospheric pressure to a final negative pressure ($1.5\times10^{-3}$ to $4\times10^{-4}$ Pa) and can be carried out continuously or in stages.

It is indicated here that sheet is understood to mean a material whose thickness is generally between 0.1 and 5 mm and whose surface area can roach several square meters.

The sheet, from which the liquid has been removed and which has optionally been dried, can be sintered.

Sintering is conventionally carried out under air at a temperature greater than the softening point of the binder.

In the case where only preparation of the electroactivated material according to the invention is targeted, a subsequent treatment is to be implemented for the purpose of removing the porogenic agent, if it in present. Thus, in the case where the porogenic agent is silica, a treatment with sodium hydroxide is carried out.

If the object in to prepare a composite material according to the invention, on a sheet obtained by implementing the above stages, a dispersion is deposited by filtering under programmed vacuum.

This dispersion comprises the constituent components of a diaphragm and is obtained in a way entirely analogous to the process used for preparing the first dispersion.

However, it should be noted that the constituent components of this dispersion can be dispersed in water or in an aqueous sodium hydroxide solution.

In the second case, care will be taken to choose constituent components which are dispersible in such a medium.

Analogously to the preparation of the first sheet, the liquid is removed and the diaphragm thus formed is optionally dried.

A sintering operation of the whole unit is subsequently carried out under conditions identical to those mentioned in Stage (d).

It should be noted that several variants are possible an regards the sintering.

According to a first variant, each sintering stage mentioned is carried out.

It should be noted that this variant is particularly appropriate when the binder employed in each of the dispersions in different.

Such a variant can likewise be employed when the first dispersion comprises a porogenic agent which can be removed by an alkaline treatment and when an aqueous sodium hydroxide solution in the dispersing medium of the second. In such a came, it is specified that a stage of removal of the porogenic agent, if it forms part of the composition of the first dispersion, is not necessary after the sintering operation of the Stage (d), since the subsequent deposition of the diaphragm corresponds to such a treatment.

According to a second variant and in the specific case where the two dispersions are in aqueous medium and where the binder which forms part of the composition of the two abovementioned dispersions in the same, advantageously only a single sintering stage is carried out, that corresponding to Stage (f).

Concrete but non-limiting examples of the invention will now be presented.

EXAMPLES

EXAMPLES 1 TO 4

The subject of Examples 1 to 4 is the study of the behaviour of the pelletized electrocatalytic agent obtained according to the following methods The electrocatalytic agent is mixed with a PTFE suspension containing 60% solids, and the whole mixture is pressed against a nickel mesh with a pressure of 1000 kg/cm$^2$.

A stage of consolidation of the structure in then carried out by bringing the pellet to 350° C. The compact pellets obtained are tested as the cathode of a cell for the electrolysis of an aqueous sodium hydroxide solution.

Example 1, comparative: The electrocatalytic agent is a nickel powder (5 $\mu$m spherical particles).

Example 2: The electrocatalytic agent is ruthenium oxide.

Example 3: The electrocatalytic agent is a mixture obtained by mechanical synthesis, comprising nickel powder of Example 1 and ruthenium oxide powder obtained in Example 2, in a 70/30 ratio by weight.

This mixture is placed in a steel container under an inert nitrogen atmosphere and in the presence of steel beads (H-440 steel). The whole mixture is stirred for 2 hours on a SPEX-8000 shaker. The milling process leads to a mixture of Ni and $RuO_2$ in the form of particles, the periphery of which is enriched in ruthenium oxide with respect to nucleus. The mean composition by mass is $Ni_{70}Ru_{30}$.

Example 4: The electrocatalytic agent is based on graphite and ruthenium oxide. A graphite powder (Lonza), with a specific surface of 300 $m^2/g$, is placed for 1 hour in a nitric acid solution at boiling point. The powder is then filtered, rinsed and dried. The powder is introduced into an aqueous $RuCl_3$ solution ($10^{-1}$ M) and the mixture is stirred for 1 hour. The mixture is filtered and the resulting powder is rinsed 4 times with distilled water and dried for 12 hours at 110° C.

The final sintering is carried out by bringing the powder to 450° C. under a stream of air for 30 min. A stage of deagglomeration of the aggregates is carried out by milling.

The electrocatalytic agent thus prepared consists of the starting graphite covered with a layer of $RuO_2$. The percentage of $RuO_2$ by mass is 9.95±0.05%.

The electrocatalytic agents are pelletized according to the procedure described above and the pellets obtained are tested for evolution of hydrogen under the following experimental conditions:

current density 300 $mA/cm^2$ solution 6N NaOH temperature 200° C.

The overpotentials represented in the Table are determined from potentials measured with respect to a Hg/HgO reference electrode connected to the surface of the electrode via a Luggin capillary.

The ohmic fall due to the electrical resistance of the electrolyte is corrected by impedometry.

| Examples | Electro-catalytic agent | Over-potential 1st day | Over-potential 2nd day | Over-potential 3rd day | Over-potential 4th day |
|---|---|---|---|---|---|
| Example 1 | Nickel | 284 | 325 | 336 | 335 |
| Example 2 | $RuO_2$ | 81 | 77 | 79 | 83 |
| Example 3 | $Ni/RuO_2$ | 84 | 83 | 81 | 84 |
| Example 4 | $RuO_2$/ graphite | 117 | 112 | 114 | 119 |

A lowering in the overpotential and a stabilization of the latter are observed, with respect to nickel, by using an electrocatalytic agent according to the invention.

EXAMPLES 5 to 8

The subject of theme examples is the study of the behaviour of electroactivated materials, that is to say of composite materials consisting of an elementary cathode and of a shoot comprising an electrocatalytic agent as described in Examples 1 to 4.

The preparation of the material of high porosity+ electroactivated material composite which follows is common to Examples 5 to 8:

a) Preparation of the suspension 30 g of carbon fibres and 70 g of chrysotile asbestos fibres are placed in 7000 ml of softened water containing 3.3 g of surface-active agent (Triton® X 100 of the company Rohm and Haas).

After rotary stirring for 30 min, 35 g of PTFE are introduced in the form of a latex with 60% solids content.

After homogenization, 100 g of Tixosil® 33J (Rhône-Poulenc) silica are added and stirring is continued for 30 min.

b) Introduction of the electrocatalytic agent

The electrocatalytic agent is incorporated in the suspension described under (a):

Example 5, comparative: 120 g of nickel according to Example 1

Example 6: 115 g of ruthenium oxide according to Example 2

Example 7: 60 g of electrocatalytic agent according to Example 3

Example 8: 170 g of electrocatalytic agent according to Example 4.

c) Preparation of the composite material

The suspension prepared in (b) is filtered through a plaited and laminated iron elementary cathode (diameter of the wires 2 mm, opening 2 mm) by applying a vacuum gradient from atmospheric pressure to a negative pressure of 300 mbar.

The coined elementary cathode and electroactivated sheet unit is brought in an oven to 350° C. for 30 minutes.

d) Use in electrolysis

The materials prepared are used as cathode component in a cell for the electrolysis of a 6N aqueous sodium hydroxide solution at 80° C. percolating through the cathode assembly.

The potential is measured with respect to a Eg/HgO reference electrode connected to the surface of the sheet via a Luggin capillary.

The ohmic fall due to the electrical resistance of the electrolyte is corrected by impedometry.

The electrolyte current density is 300 $mA/cm^2$.

| | Electroactivated sheet | | | | |
|---|---|---|---|---|---|
| Examples | Weight ($kg/cm^2$) | Activation | Electrocat. agent m. ($mg/cm^2$) | Correspond-ing $RuO_2$ m. ($mg/cm^2$) | Over-potential $\eta$ (mV) |
| Example 5, com-parative | 0.5 | Ni | 16.9 | | 283 |
| Example 6 | 0.5 | $RuO_2$ | 3 | 3 | 146 |
| Example 7 | 0.5 | $Ni/RuO_2$ | 10.2 | 3.1 | 104 |
| Example 8 | 0.65 | $RuO_2$/ graphite | 27.3 | 2.74 | 65 |

It emerges from the analysis of this table that the incorporation of ruthenium oxide greatly decreases the cathode overpotential. This decrease becomes greater as the oxide becomes dispersed over a support.

EXAMPLES 9 to 11

The subject of these examples is the study of the behaviour of electroactivated materials consisting of an elementary cathode, an electroactivated sheet and a diaphragm.

Example 9, comparative: the combined elementary cathode and electroactivatod shoot unit is obtained according to the method described for Examples 5 to 8, except for the fact that only graphite powder is used.

Example 10: the combined elementary cathode and electroactivated shoot unit corresponds to that obtained in Example 6.

Example 11: the combined elementary cathode and electroactivated sheet unit corresponds to that obtained in Example 8.

In all three cases, a diaphragm in deposited on the combined electroactivated material/elementary cathode unit according to the following procedure:

A suspension is prepared, with stirring, comprising:

3.3 g of surface-active agent;

100 g of chrysotile asbestos fibres with lengths of less than 1 mm;

20 g of PTFE in the latex form containing approximately 60% by weight of solids;

30 g of Tixosil® 33J (Rhône-Poulenc);

deionized water, the amount of which is calculated in order to obtain approximately 4 liters of suspension and a solids content of approximately 4.5%.

The suspension is allowed to stand for at least 24 hours. The suspension is stirred for 30 minutes before use.

The required volume of solution is withdrawn so that it contains the amount of solid which it is intended to deposit in order to form the diaphragm (of the order of 1 to 2 kg/$M^2$).

Filtration is carried out under programmed vacuum. Negative pressure is established and increases by 50 mbar per minute in order to reach approximately 800 mbar. The negative pressure is maintained for 15 minutes at 800 mbar.

The combined unit is then sintered, after optional drying at approximately 100° C., the combined diaphragm and cathode unit being brought to 350° C., with a stationary stage at a temperature of approximately 315° C., the whole process lasting approximately 1 hour and a half.

The silica is then removed by an alkaline attack with electrolytic sodium hydroxide during the first moments of the electrolysis ("in situ" removal).

The three elementary cathode/electroactivated material/diaphragm composite materials are tested as the cathode component of a cell for the electrolysis of an aqueous sodium chloride solution. The chloride supply in kept constant with a concentration of 280 g/l and a temperature of 80° C.

| Examples | Electrocatalytic agent | $\Delta U_{I+O}$ (V) |
|---|---|---|
| Example 9, comparative | graphite | 2.36 |
| Example 10 | $RuO_2$ | 2.21 |
| Example 11 | graphite + $RuO_2$ 9.95 wt % | 2.19 |

$\Delta U_{I+O}$ is calculated from the plot of the cell potential ($\Delta U$) as a function of the electrolysis current.

This table makes it possible to evaluate the activation of the cathode by the electrocatalytic agent. It clearly appears that the use of ruthenium oxide substantially decreases the extrapolated potential and that this effect is increased when the ruthenium oxide is dispersed over a support (graphite, for example).

What is claimed is:

1. An electroactivated material comprising fibres, of which at least a part is electrically conducting, and a binder, said material further comprising an electrocatalytic agent comprising an electrically conductive support material coated with one or several oxide of a precious metal selected from the group consisting of ruthenium, platinum, palladium, iridium and their mixture.

2. A material according to claim 1, wherein the electrocatalytic agent is uniformly distributed throughout the material.

3. A material according to claim 1, wherein the electrocatalytic agent is in the form of a coating on the support and the proportion by weight of coating with respect to the support varies from 0.5 to 50 for each particle.

4. A material according to claim 1, wherein the support is selected from the group consisting of iron, cobalt, nickel, Raney iron, Raney cobalt, Raney nickel, the elements from columns IVA and VA of the periodic classification, and graphite.

5. A material according to claim 1, wherein the support is in the form of a powder having a particle size of between 1 and 100 $\mu$m.

6. A material according to claim 1, wherein the electrocatalytic agent represents 10–70% by weight, with respect to the combined fibres, binder and electrocatalytic agent.

7. A material according to claim 1, wherein the electrocatalytic agent further comprises an additive selected from the group consisting of iron, cobalt, nickel and their oxides.

8. A material according to claim 1, wherein the fibres represent 10–65% and the binder 5–20%, with respect to the weight of the combined fibres, binder and electrocatalytic agent, the weight of binder corresponding to 20–50% by weight, with respect to the fibres and binder.

9. A composite material comprising (i) a material having a mesh opening of between 20 microns 5 mm, and (ii) the electroactivated material according to claim 1.

10. A composite material according to claim 9, having two faces and comprising, from one face towards the other, (i) a metal surface of high porosity, (ii) the electroactivated material, and (iii) a separator.

11. A process for the preparation of an electroactivated material comprising fibres, of which at least a part is electrically conducting, and a binder, said material further comprising an electrocatalytic agent comprising an electrically conductive support material coated with one or several oxide of a precious metal selected from the group consisting of ruthenium, platinum, palladium, iridium and their mixture, said process comprising the steps of:

(a) preparing an aqueous suspension comprising the fibres, the binder, the electrocatalytic agent;

(b) depositing a sheet by filtering the said suspension, under programmed vacuum, through a material having a mesh opening of between 20 microns and 5 mm;

(c) removing the liquid and drying the sheet thus formed; and (d) sintering the sheet thus obtained.

12. A process for the preparation of a composite material having two faces and comprising, from one face towards the other:

(i) a metal surface of high porosity;

(ii) an electroactivated material comprising fibres, of which at least a part is electrically conducting, a binder, and an electrocatalytic agent comprising an electrically conductive support material coated with one or several oxide of a precious metal selected from the group of ruthenium, platinum, palladium, iridium and their mixture; and (iii) a separator;

said process comprising the steps of:

(a) preparing an aqueous suspension comprising the fibres, the binder, and the electrocatalytic agent;

(b) depositing a sheet by filtering the said suspension, under programmed vacuum, through a material having a mesh opening of between 20 microns and 5 mm;

(c) removing the liquid and drying the sheet thus formed;

(d) sintering the sheet thus obtained;

(e) depositing a dispersion, in water or in an aqueous sodium hydroxide solution, comprising fibres, and a binder, on the said sheet by filtering under programmed vacuum to form a unit;

(f) removing the liquid and drying a diaphragm thus formed; and (g) sintering the whole unit.

13. A process according to the claim 12, further comprising after step (g) the following step:

(h) carrying out a treatment with an aqueous alkali metal hydroxide solution, if the dispersion of step (e) is in water and if it comprises silica as porogenic agent.

14. A process for the electrolysis of an aqueous sodium chloride solution, comprising the step of carrying out said electrolysis with a cell whose cathode comprises the electroactivated material of claim 1.

15. A material according to claim 1, wherein the electrically conductive support comprises a powder.

16. A material according to claim 15, wherein the support comprises carbon powder.

17. A material according to claim 1, wherein the support comprises carbon, the surface of the support being oxidized prior to coating with the one or several oxide of a precious metal.

18. A process according to claim 12, further comprising after step (g) the following step:

(h) carrying out a treatment with a porogenic agent.

* * * * *